US007553808B2

(12) United States Patent
Tee, Jr. et al.

(10) Patent No.: US 7,553,808 B2
(45) Date of Patent: Jun. 30, 2009

(54) MULTIPLE USE FABRIC SOFTENING COMPOSITION WITH REDUCED FABRIC STAINING

(75) Inventors: Johannson Jimmy Tee, Jr., West Chester, OH (US); Fernando Ray Tollens, Cincinnati, OH (US); Jiping Wang, West Chester, OH (US); Jacqueline Marie Duderstadt, Cincinnati, OH (US); Michael Rene Weaver, Cincinnati, OH (US); Steven Robert Sealschott, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 265 days.

(21) Appl. No.: 11/526,042

(22) Filed: Sep. 22, 2006

(65) Prior Publication Data

US 2007/0066511 A1 Mar. 22, 2007

Related U.S. Application Data

(60) Provisional application No. 60/719,646, filed on Sep. 22, 2005.

(51) Int. Cl.
*C11D 1/825* (2006.01)

(52) U.S. Cl. ..... 510/475; 510/501; 510/519

(58) Field of Classification Search ..... 510/475, 510/501, 519
See application file for complete search history.

(56) References Cited

U.S. PATENT DOCUMENTS

| | | | | |
|---|---|---|---|---|
| 3,442,692 | A | 5/1969 | Gaiser | |
| 3,676,199 | A | 7/1972 | Hewitt et al. | |
| 3,686,025 | A | 8/1972 | Morton | |
| 6,020,302 | A * | 2/2000 | Leurentop et al. | 510/475 |
| 2003/0192197 | A1 | 10/2003 | Griese et al. | |
| 2004/0167056 | A1 * | 8/2004 | Lentsch et al. | 510/504 |

FOREIGN PATENT DOCUMENTS

| | | | |
|---|---|---|---|
| WO | WO 2005/026432 | A | 3/2005 |
| WO | WO 2005/085404 | A | 9/2005 |

OTHER PUBLICATIONS

PCT International Search Report Dated Sep. 23, 2008—4 pgs.

* cited by examiner

*Primary Examiner*—John R Hardee
(74) *Attorney, Agent, or Firm*—David V. Upite; Mark A. Charles; Kim William Zerby

(57) ABSTRACT

An article comprising a multiple use fabric conditioning composition that is operably connectable to the inside of a dryer is useful for softening fabric without staining the fabric.

18 Claims, No Drawings

MULTIPLE USE FABRIC SOFTENING COMPOSITION WITH REDUCED FABRIC STAINING

CROSS REFERENCE TO RELATED APPLICATION

This application claims the benefit of U.S. Provisional Application No. 60/719,646, filed Sep. 22, 2005.

FIELD OF THE INVENTION

The present invention is directed multiple use, dryer-added, fabric softening compositions.

BACKGROUND OF THE INVENTION

Dryer-added fabric softening products provide a convenient way for a consumer to provide fabric conditioning benefits to laundry.

Generally, there are two main types of dryer-added fabric softening products, namely, single use products and multiple-use products. Single use products, most commonly in the sheet form coated with a fabric softening composition, call for adding a single sheet into an automatic clothes dryer containing a wet laundry load, at the beginning of the drying cycle. Examples of these types of products are disclosed in U.S. Pat. Nos. 3,442,692 and 3,686,025.

Multiple use fabric softening products are placed in the interior of the dryer to release the fabric conditioning component to successive laundry loads. Each multiple-use product lasts many drying cycles and thus provides a better convenience to the consumer than a single use product. Examples of multiple-use products include those described in U.S. Pat. No. 3,676,199 and US 2003/0192197 A1.

A problem facing such multiple use products, particularly those products having uses over 20, or 30, or more cycles, is the potential for fabric staining on dark heavy laundry. The addition of perfume to these products may also exacerbate the problem. Without wishing to be bound by theory, the fabric staining usually results earlier in the product's life cycle (e.g., the first cycle) when the product is less dense opposed to later on when the bar becomes "cured" having gone through multiple dryer cycles. There is a need to provide a multiple use fabric softening product that minimizing fabric staining (particularly in the first cycle), yet provides effective fabric softening and/or freshening benefits throughout the course of the product life span (e.g., over 40 or more cycles).

SUMMARY OF THE INVENTION

The present invention attempts to solve these and other problems by providing, in one aspect of the present invention, a multiple use, dryer added, article comprising a fabric softening composition, wherein the fabric softening composition comprises a fabric softening active, a wax, and a wax additive, wherein the wax additive is chosen from polyethylene compound, polypropylene compound, or combination thereof.

Another aspect of the invention provides for a method of softening a fabric comprising the step of contacting the fabric, with an article of the present invention, in an automatic laundry dryer.

Another aspect of the invention provides for a kit comprising an article according to the present invention.

DETAILED DESCRIPTION OF THE INVENTION

Definitions:

"Fabric" refers to any textile or fabric material that is laundered, e.g., garment.

"Fabric softening active" is used herein in the broadest sense to include any compound that is suitable for softening fabric. In one embodiment, the fabric softening active is a quaternary ammonium compound. In one embodiment, the quaternary ammonium compound is chosen from at least one of the following: an alkylated quaternary ammonium compound, ring or cyclic quaternary ammonium compound, aromatic quaternary ammonium compound, diquaternary ammonium compound, alkoxylated quaternary ammonium compound, amidoamine quaternary ammonium compound, ester quaternary ammonium compound, or combination thereof. In yet another embodiment, the cationic fabric softening active is one chosen from US 2003/0195130, paragraphs 14-17. An example of such a fabric softening active includes VARISOFT 110 from Degussa Inc. Another example includes Methyl-bis(Hydrogenated Tallow Amidoethyl) 2-Hydroxyethyl-Ammonium Methyl Sulfate. The quaternary ammonium compound may comprise from about 5% to about 95%, alternatively from about 35% to about 60%, alternatively about 45% to about 60%, alternatively from about 46% to about 53%, by weight of the fabric conditioning composition. In one embodiment, the fabric softening composition is free or essentially free of water.

"Multiple use," means the fabric softening article may be used to deliver a desired amount of a fabric softening active to fabric during at least two cycles for drying laundry in an automatic laundry dryer, preferably at least about 10 cycles, more preferably at least about 20 cycles, even more preferably at least about 30 cycles, yet more preferably at least about 40 cycles, alternatively at least about 50 cycles, alternatively at least about 60 cycles, before the fabric conditioning composition needs to be replaced. In one embodiment, the term "multiple use" is not greater than 200 cycles, alternatively not greater than 100 cycles.

"Operably connectable to an inside surface of a dryer" is used herein in the broadest sense to include any means of attaching the article of the present invention to the inside surface of an automatic laundry dryer. The inside surface of the dryer may include the barrel, baffle or inside of the door of the dryer. The means attaching may include an adhesive that can be used to releasably affix the composition and composition carrier to the inside surface of a dryer. Alternatively, the means of attaching the article may also include a docking member such as one described in U.S. Pat. Pub. 2003/0192197 A1 published Oct. 16, 2003.

"Perfume" is used to indicate any odoriferous material. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Non-limiting examples of different perfume compositions are given in US. 2003/0104969 A1; U.S. Pat. No. 5,714,137; U.S. Pat. No. 6,048,830. In one embodiment of the invention, the composition comprises at least 2%, alternatively, at least about 2.5%, alternatively at least about 3%, alternatively at least about 4% perfume by weight of the fabric softening composition. Without wishing to be by bound by theory, it is believe the addition of the wax additives of the present invention allows for a fabric softening compositions with higher levels of perfume without providing a fabric softening compositions that will stain fabric during a first cycle of an automatic laundry dryer with the fabric softening composition.

"Wax" is used herein in the broadest sense to include any wax that is suitable for use in an automatic laundry dryer and has a melting point that can be above about 90° C., alternatively above about 95° C., alternatively above about 100° C., or above about 110° C., or above about 120° C. The melting temperature of the wax can be below 200° C., below about 180° C., or below about 170° C. The wax may comprise from about 5% to about 55%, alternatively from about 10% to about 50%, alternatively from about 15% to about 45%, alternatively from about 43% to about 51%, alternatively from about 33% to about 41%, alternatively from about 30% to about 40%, by weight of the fabric softening composition. Suitable non-limiting examples of a wax for purposes of the present invention comprises at least one of the following: ethylene bisamides, primary alkylamides, alkanolamides, polyamides, alcohols containing at least 12 carbon atoms, alkoxylated alcohols containing alkyl chain of at least 12 carbon atoms, carboxylic acids containing at least 12 carbon atoms, and derivatives thereof. In one embodiment, the wax is chosen from ethylenebisteramide, ethylenebisoleamide, ethylenebisbehenamide, and mixtures thereof. In another embodiment, the wax comprises ethylene bisstearamide. In yet another embodiment, the wax is one selected from US 2003-0195130 A1 from paragraphs 18-23. Suitable waxes may be commercially available from Lonza such those under name of ACRAWAX C. In one embodiment, the fabric softening composition is a solid at 22° C.

Wax Additives

One aspect of the invention provides for an article comprising a fabric softening composition, wherein the fabric softening composition comprises inter alia a wax additive. Without wishing to be bound by theory, the addition of the wax additives of the present invention may mitigate, preferably prevent, the fabric staining to fabric by the use of a multiple use, dryer added, article yet still provide the commercially acceptable fabric softening over the course of the product's life span. The present invention is based, in part, upon the surprising discovery that the use of wax additives comprising polyethylene compound and/or polypropylene compound may meet these technical challenges.

The term "polyethylene compound" is defined herein to include any compound that comprises a polyethylene moiety. The term "polypropylene compound" is defined herein to include any compound that comprises a polypropylene moiety. In one embodiment, the fabric softening composition of the present invention comprises at least about 10% by weight of the composition of the wax additive, alternatively from about 15% to about 45%, alternatively from about 20% to about 40%, alternatively from about 25% to about 40%, alternatively from about 10% to about 45%, by weight of the fabric softening composition. Non-limiting examples of a wax additive of the present invention include: a polyethylene oxidized homopolymer, polyethylene high density oxidized homopolymer, propylene maleic anhydride copolymes, ethylene maleic anhydride copolymer, polypropylene homopolymer, polypropylene maleic anhydride polymer, derivatives thereof, and combinations thereof. Suitable examples of wax additives include AC316 and AC950P from Honeywell, and EPOLENE N-21 and EPOLENE E-43 from Eastman Chemicals.

Method of Making

One aspect of the invention provides for making a fabric softening composition of the present invention providing the steps of mixing the components of the composition, including the wax additives of the present invention, at a temperature sufficient to melt all the components. The step of mixing preferably takes place at a temperature in excess of about 100° C. In general, the components should not be mixed at a temperature that is so high that it harms or discolors the components of the composition. For many components of the fabric softening composition, the mixing temperature can be less that about 180° C. Further steps to make the compositions of the present invention may include those described in US 2003/0195130 A1, paragraphs 25 to 26.

Kit

Another aspect of the present invention provides a kit, wherein the kit comprises a composition of the present invention. In one embodiment, the kit further comprises instructions instructing the use to place an article, comprising a composition of the present invention, to an inside surface of the dryer. In one embodiment, the kit comprising a article, wherein the article comprises a composition according to the present invention; but wherein the article is free of a perforated membrane for exuding the composition through the perforation on to the surface of the article. An example of such a "perforated membrane" excluded from the scope of at least one embodiment of the invention is one described at U.S. Pat. No. 4,014,432. In another embodiment, the kit comprises an article, wherein the article comprises a composition of the present invention and is operably connectable to an inside surface of a dryer. The kit may optionally comprise instructions instructing the user to operably connect the article to the inside surface of the dryer.

EXAMPLES

| Ingredient | I | II | III | IV | V | VI |
|---|---|---|---|---|---|---|
| Varsioft 110 ™ | 48.5% | 50% | 53% | 48% | 50% | 53% |
| ACRAWAX | 24.25% | 17.625% | 16.5% | 21.4375% | 17.625% | 16.5% |
| AC 316[1] | 24.25% | 29.375% | 27.5% | — | — | — |
| AC 395 | — | — | — | 27.5625% | 29.375% | — |
| AC 325 | — | — | — | — | — | 27.5% |
| AC 820 | — | — | — | — | — | — |
| Perfume | 3% | 3% | 3% | 3% | 3% | 3% |

| Ingredient | VII | VIIIIe |
|---|---|---|
| KRA | 55% | 48% |
| ACRAWAX | 18.375% | 18.375% |

-continued

| | | |
|---|---|---|
| AC 316 | — | — |
| AC 395 | — | — |
| AC 325 | 23.625% | — |
| AC 820 | — | 30.625% |
| Perfume | 3% | 3% |

[1]"AC" series of wax additives are available from Honeywell Specialty Additives.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

Except as otherwise noted, the articles "a," "an," and "the" mean "one or more."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All percentages stated herein are by weight unless otherwise specified. It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multiple use, dryer added, article comprising a fabric softening composition, wherein the fabric softening composition comprises a fabric softening active, a wax, and a wax additive;

wherein the wax additive is a polyethylene oxidized homopolymer, and comprises at least about 15% by weight of the composition; and wherein the wax comprises ethylene bisstearmide;

wherein the article is operably connectable to an inside surface of a dryer.

2. The article of claim 1, wherein the fabric softening active comprises a quaternary ammonium compound.

3. The article of claim 2, wherein the quaternary ammonium compound is chosen from at least one of the following alkylated quaternary ammonium compounds, ring or cyclic quatemary ammonium compounds, aromatic quatemary ammonium compounds, diquaternary ammonium compounds, alkoxylated quatemary ammonium compounds, amidoamine quaternary ammonium compounds, ester quaternary ammonium compounds, and combinations thereof.

4. The article of claim 3, wherein the fabric softening composition further comprises more than 2% perfume by weight of the composition.

5. The article of claim 4 wherein the fabric softening composition comprises at least about 3% perfume by weight of the composition.

6. The article of claim 1, wherein the fabric softening active comprises from about 45 to about 60% of the composition.

7. The article of claim 6, wherein the wax comprises from about 15% to about 45% of the composition.

8. The article of claim 7, wherein the fabric softening composition is a solid at 22° C.

9. The article of claim 8, wherein the article is free of a perforated membrane.

10. A method of softening fabric comprising the step of contacting the fabric with an article according to claim 1 inside an automatic clothing dryer.

11. A kit comprising an article according to claim 1.

12. The article of claim 1, wherein the wax additive comprises from about 15% to about 45% by weight of the composition.

13. The article of claim 1, wherein the wax additive comprises from 15% to about 45% by weight of the composition.

14. The article of claim 1, wherein the wax additive comprises from about 20% to about 45% by weight of the composition.

15. The article of claim 1, wherein the wax additive comprises from 20% to about 45% by weight of the composition.

16. The article of claim 1, wherein the wax additive comprises at least 20% by weight of the composition.

17. The article of claim 1, wherein the wax additive comprises at least 20% by weight of the composition.

18. The article of claim 1, wherein the wax additive comprises at least from 25% to about 45% by weight of the composition.

* * * * *